United States Patent [19]

Faulkner

[11] 3,963,077

[45] June 15, 1976

[54] METHOD OF PREVENTING WELL BORE DRILLING FLUID OVERFLOW AND FORMATION FLUID BLOWOUTS

[76] Inventor: Ben V. Faulkner, 1904 Westbrook Terrace, Norman, Okla. 73069

[22] Filed: June 18, 1975

[21] Appl. No.: 587,914

[52] U.S. Cl. ..... 166/315; 175/25

[51] Int. Cl.[2] ..... E21B 23/00

[58] Field of Search ..... 166/75, 85, 315; 175/25, 48, 69, 71, 205, 212; 73/155

[56] References Cited

UNITED STATES PATENTS

| | | | |
|---|---|---|---|
| 2,832,566 | 4/1958 | Bielstein | 175/69 |
| 3,384,178 | 5/1968 | Agnew et al. | 166/75 |
| 3,613,806 | 10/1971 | Malott | 166/75 |
| 3,638,485 | 2/1972 | Knauth | 73/155 |
| 3,646,808 | 3/1972 | Leonard | 73/155 |
| 3,729,986 | 5/1973 | Leonard | 73/155 |
| 3,889,959 | 6/1975 | Persson | 175/212 |

*Primary Examiner*—Ernest R. Purser
*Assistant Examiner*—Jack E. Ebel
*Attorney, Agent, or Firm*—C. Clark Dougherty, Jr.

[57] ABSTRACT

The present invention relates to a method of preventing drilling fluid overflow and uncontrolled formation fluid blowouts when removing drill pipe sections from a drill string disposed in a well bore which penetrates a subterranean formation and is filled with drilling fluid. A gas is introduced into the annulus until a predetermined gas pressure is reached therewithin thereby displacing drilling fluid from the well bore and downwardly in the annulus a distance such that upon releasing the gas pressure from the annulus the level of drilling fluid in the drill string is below the level at which the drill pipe sections are disconnected therefrom, but above the level at which the hydrostatic head exerted on the formation by the drilling fluid equals the pressure of fluids contained within the formation. The gas pressure is released from the annulus and a predetermined number of drill pipe sections are removed from the drill string whereby the level of drilling fluid in the well bore is prevented from reaching the level at which the hydrostatic head exerted on the formation by the drilling fluid is below the pressure of the formation fluids. The annulus is refilled with drilling fluid and the foregoing steps repeated until a desired number of drill pipe sections are removed from the drill string.

5 Claims, 2 Drawing Figures

METHOD OF PREVENTING WELL BORE DRILLING FLUID OVERFLOW AND FORMATION FLUID BLOWOUTS

BACKGROUND OF THE INVENTION

1. Field of the Invention

The present invention relates generally to the drilling of oil and gas wells, and more particularly, but not by way of limitation, to a method of preventing drilling fluid overflow and the occurrence of uncontrolled formation fluid blowouts when removing drill pipe sections from a drill string disposed in a well bore.

2. Description of the Prior Art

In the drilling of well bores penetrating subterranean formations, uncontrolled formation fluid blowouts can occur when a formation is penetrated containing fluids at pressures exceeding the hydrostatic head exerted on the formation by the column of drilling fluid contained in the well bore. While mechanical blowout preventer apparatus are commonly used in well bore drilling operations which function to shut off the annulus between the walls of the well bore (the surface casing) and the drill string disposed therein, such apparatus are effective in stopping blowouts only after they have commenced, often resulting in expensive and time-consuming delays while heavy fluid is pumped into the well bore to increase the hydrostatic head on the penetrated formation and kill the well.

One of the main causes of formation fluid blowouts during drilling operations is the failure to adequately compensate for the loss of drilling fluid level in the well bore during the withdrawal of the drill string therefrom. It is frequently necessary to withdraw the drill string from the well bore to change the drill bit, replace worn out drill pipe sections, etc. Because during drilling, drilling fluid is circulated down the drill string, through ports in the drill bit and up the annulus between the drill string and the walls of the well bore to the surface, when removal of the drill string is necessary the drill string and the annulus are completely filled with drilling fluid. Generally for economic reasons the density of the drilling fluid utilized is maintained at a minimum level but such that the hydrostatic pressure exerted by the column of drilling fluid on the bottom of the well bore exceeds formation fluid pressures which are encountered thereby preventing formation fluids from entering the well bore. During drilling when the drill string and annulus are filled with drilling fluid the required hydrostatic head is relatively simple to maintain. However, during the removal of the drill string from the well bore when the circulation of drilling fluid is stopped, the level of drilling fluid within the well bore can very easily be inadvertently allowed to lower to a point whereby the hydrostatic head exerted at the bottom of the well bore is lower than the pressure of fluids contained in a formation penetrated by the well bore resulting in the formation fluids entering the well bore and flowing up the annulus, i.e., a blowout which can result in the loss of life, energy, material and cause damage to the environment.

Another problem that often occurs during the withdrawal of the drill string from the well bore is the overflow of drilling fluid through the drill string as drill pipe sections are disconnected therefrom resulting in the loss of drilling fluid and the lowering of the level of drilling fluid in the well bore. Such overflow is due to the drilling fluid in the annulus being of a higher density than the drilling fluid within the drill string which causes the level of drilling fluid in the drill string to be higher than the level in the annulus. That is, because the drilling fluid is circulated while drilling, the fluid inside the drill string is relatively free of drilled solids while the fluid in the annulus is carrying newly drilled solids to the surface for removal. In addition, the drill bit at the bottom of the drill string includes nozzles of restricted cross-sectional area which inhibit the drainage of the drill string and the equilization of the levels of drilling fluid in the drill string and the annulus. When the circulation of drilling fluid is stopped for the removal of the drill string, the combination of the above factors results in the level of drilling fluid in the drill string being above the point at which drill pipe sections are disconnected from the drill string which in turn causes drilling fluid to overflow from the drill string at the point of disconnection. As is well understood by those skilled in the art, in removing drill pipe sections from the drill string, the drill string is raised within the well bore which lowers the level of drilling fluid therein. Thus, during the withdrawal of the drill string, overflow initially occurs which lowers the level of the drilling fluid in the well bore, and because drilling personnel are reluctant to refill the annulus with drilling fluid which will cause additional overflow (even though they are generally directed to do so) the continued withdrawal of the drill string from the well bore results in a further lowering of the level of drilling fluid therein, often to the extent of allowing formation fluids to enter the well bore and a dangerous blowout condition to occur.

by the present invention a method of preventing drilling fluid overflow and the occurrence of uncontrolled formation fluid blowouts during the removal of the drill string from a well bore is provided. The practice of the method brings about the accurate and constant control of the level of drilling fluid within the well bore during withdrawal of the drill string thereby insuring the prevention of uncontrolled blowouts and eliminating undesirable overflow.

SUMMARY OF THE INVENTION

The present invention is directed to a method of preventing drilling fluid overflow and the occurrence of uncontrolled formation fluid blowouts when removing drill pipe sections from a drill string disposed in a well bore penetrating a subterranean formation and filled with drilling fluid. By the invention, a gas is introduced into the annulus between the walls of the well bore and the drill string until a predetermined gas pressure is reached therewithin thereby displacing drilling fluids out of the well bore by causing the fluids to flow downwardly through the annulus and upwardly through the drill string. The level of drilling fluid is lowered by the gas pressure a distance such that upon releasing the gas pressure from the annulus the level of drilling fluid in the drill string is below the level at which the drill pipe sections are disconnected therefrom, but above the level at which the hydrostatic head exerted on the formation by the column of drilling fluid in the well bore equals the pressure of fluids contained within the formation. The gas pressure is released from the annulus and drill pipe sections are removed from the drill string thereby raising the drill string within the well bore and lowering the level of drilling fluid therein, the number of sections removed being limited so that the level at which the hydrostatic head exerted by the column of drilling fluid at the bottom of the well bore equals the pressure of fluids contained within the formation. After removing the predetermined number of drill pipe sections, the annulus is refilled with drilling fluid and the foregoing procedure is repeated until the desired number of drill pipe sections are removed from the drill string or the entire drill string is removed from the well bore.

It is, therefore, a general object of the present invention to provide a method of preventing drilling fluid overflow and the occurrence of uncontrolled formation fluid blowouts during the removal of drill pipe sections from a drill string disposed in a well bore.

A further object of the present invention is the provision of a method whereby the location of the level of drilling fluid within a well bore is known at all times during the removal of a drill string therefrom.

Yet a further object of the present invention is the provision of a method of positively assuring that the level of drilling fluid within a well bore is maintained above the level at which the hydrostatic head exerted on a formation penetrated by the well bore equals the pressure of fluids contained within the formation thereby preventing the occurrence of uncontrolled blowouts of the formation fluids.

Other and further objects, features and advantages of the invention will be readily apparent to those skilled in the art upon a reading of the description of preferred embodiments which follows when taken with the accompanying drawings.

DESCRIPTION OF PREFERRED EMBODIMENTS OF THE INVENTION

Figure 1:
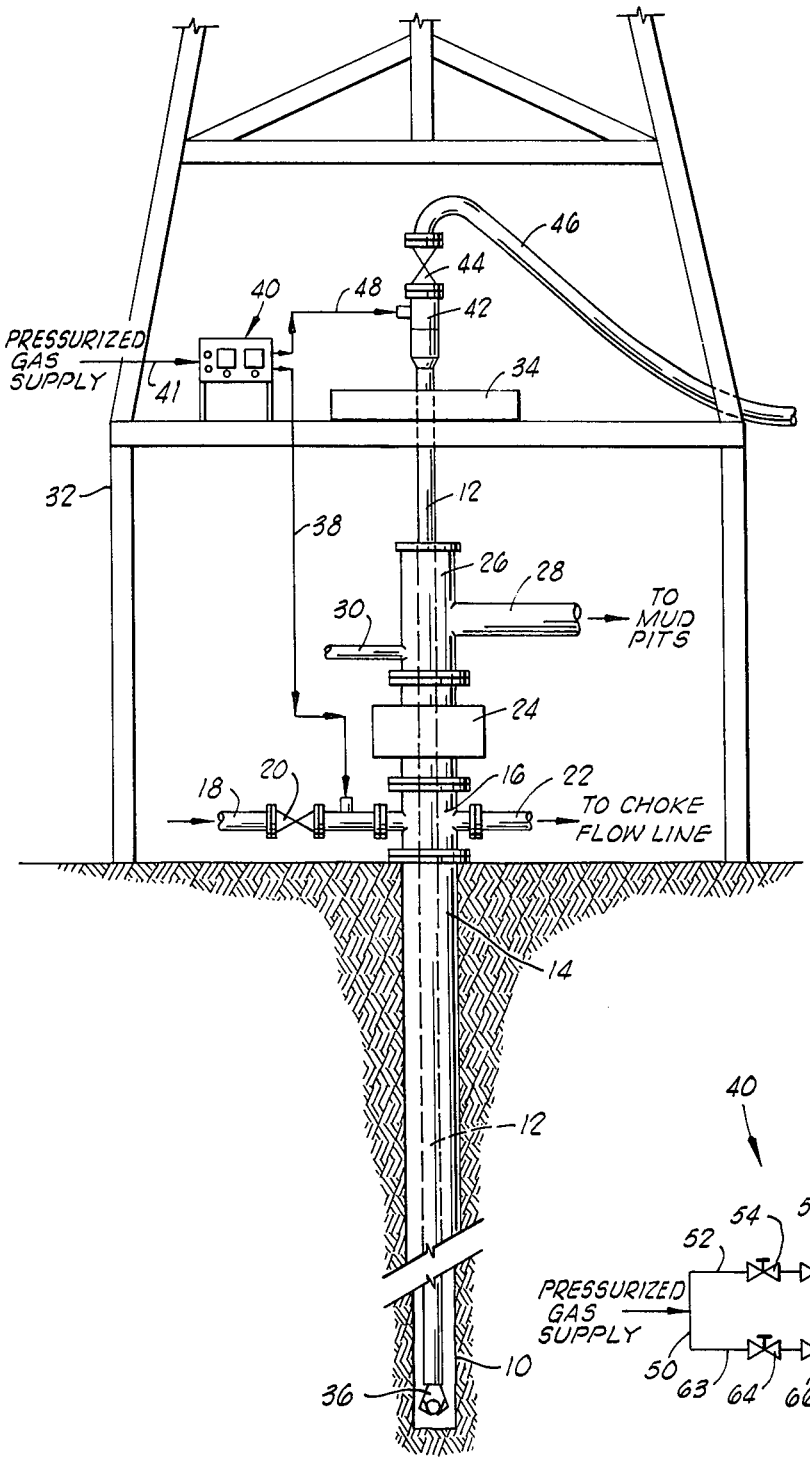
FIG. 1 is a diagrammatic illustration of a well bore having conventional rotary drilling apparatus connected thereto including apparatus for carrying out the method of the present invention.

Referring now to the drawings and particularly to FIG. 1, a well bore 10 is illustrated having a conventional string of drill pipe sections 12 disposed therein. The well bore 10 is equipped with the usual arrangement of well head apparatus including surface casing 14 disposed in the well bore and connected to a drilling spool 16 at the ground surface. A conduit 18 is connected to the drilling spool 16 and to a source of weighted fluid, i.e., to the discharge of the mud pumps, and a shutoff valve 20 is disposed in the conduit 18. A second conduit 22 is connected to the drilling spool 16 and to a flow line having a choke or other flow regulating valve disposed therein. As is well understood by those skilled in the art, the conduit 22 and choke connected thereto are utilized to relieve formation fluid pressures from the well bore 10 in the event of a blowout, and the conduit 18 is utilized to introduce weighted fluid into the well bore 10 to increase the hydrostatic head exerted on the formation from which fluids are flowing into the well bore to stop the flow of such fluids, i.e., to kill the well. One or more conventional blowout preventer apparatus 24 are connected to the drilling spool 16, and a conventional bell nipple 26 is connected above the blowout preventers 24 to complete the well head assembly. A large diameter conduit 28 is connected to the nipple 26 for conducting circulated drilling fluid from the annulus between the drill string 12 and the walls of the well bore 10 to the mud pits. A second conduit 30 is connected to the nipple 26 for introducing drilling fluid into the annulus when refilling the annulus as will be described further hereinbelow.

In carrying out the rotary drilling of well bores, a drilling rig 32 is positioned above the well bore which includes a rotary table 34 for rotating the drill string 12 and a drill bit 36 connected to the bottom end of the drill string 12. During drilling, drilling fluid is circulated downwardly through the drill string 12, through nozzles in the drill bit 36, upwardly through the annulus between the drill string 12 and the walls of the well bore 10 and through the conduit 28 to the mud pits and apparatus whereby cuttings produced by the drill bit 36 are removed from the drilling fluid. Conditioned drilling fluid is pumped by mud pumps into the top end of the drill string 12 by means of the usual flexible hose, swivel and kelly (not shown).

In accordance with the present invention, when it is necessary or desirable to remove all or a part of the drill string 12 from the well bore 10, the circulation of drilling fluid through the drill string and well bore is stopped. At this point the annulus is completely filled with drilling fluid as is the drill string 12, and as described above, the level of drilling fluid in the drill string 12 is above the floor of the drilling rig 32 and above the point of disconnection of drill pipe sections from the drill string 12. In order to prevent overflow of drilling fluid when drill pipe sections are removed from the drill string 12, the blowout preventer apparatus 24 which seals and shuts off the annulus is closed. With the kelly, swivel, etc. still connected to the top end of the drill string 12, pressurized gas is introduced into the annulus by way of a conduit or hose 38 which is connected to the conduit 18 downstream of the valve 20 and to a gas pressure regulating and recording assembly 40. A conduit 41 leads a supply of pressurized gas to the assembly 40.

Pressurized gas is introduced from the assembly 40 by way of the conduit 38 and 18 connected to the drilling spool 16 into the annulus, and is continued until a predetermined pressure level is reached in the annulus. As will be understood, the introduction of the pressurized gas into the annulus displaces drilling fluid contained in the annulus downwardly in the well bore 10, through the ports contained in the drill bit 36, upwardly through the drill string 12 and through the kelly and other apparatus of the drilling rig 32 into drilling fluid circulation tanks thereby lowering the level of drilling fluid in the annulus. The particular gas pressure utilized for displacing drilling fluid from the annulus is calculated using conventional engineering techniques so that the level of drilling fluid in the annulus is moved downwardly therein a distance whereby upon release of the gas pressure and equilization of the drilling fluid levels in the annulus and the drill string, the resulting level of drilling fluid in the drill string is below the level at which drill pipe sections are disconnected from the drill string during the removal of the drill string from the well bore, but the level of drilling fluid in the well bore is above the point at which the hydrostatic head exerted by the column of drilling fluid equals the pressure of fluids contained within such formations are prevented from flowing into the well bore and creating a blowout condition.

The gas pressure is released from the annulus by exhausting the gas to the atmosphere by way of the conduit 18 and 38, and the blowout preventer apparatus 24 is opened. Following the release of gas pressure from the annulus, a predetermined number of drill pipe sections are removed from the drill string 12 which results in the raising of the drill string 12 within the well bore 10 and the further lowering of the level of drilling fluid contained within the well bore. The specific number of drill pipe sections removed from the drill string is determined using conventional engineering techniques based on the volume of drilling fluid displaced by the drill pipe sections and the particular distance the level of drilling fluid in the well bore 10 is lowered by the removal of such sections. That is, the number of drill pipe sections removed is limited so that the level of drilling fluid remaining in the well bore 10 is maintained above the level at which the hydrostatic head produced by the drilling fluid equals the pressure of fluids contained within formations penetrated by the well bore.

After the removal of the predetermined number of drill pipe sections from the drill string 12, a special threaded adapter 42 having a shutoff valve 44 and a flexible hose 46 connected thereto is threadedly connected to the top end of the drill string 12. The flexible hose 46 leads to the mud pits or circulating tanks, and a flexible hose 48 is connected to the adapter 42 and to the gas regulating and recording assembly 40. Once the adapter 42 has been connected to the drill string 12, the valve 44 is closed and gas is introduced from the assembly 40 by way of the hose 48 into the drill string 12 until a predetermined gas pressure level is reached therein. The particular gas pressure level utilized is determined using conventional engineering techniques, and is that gas pressure which when exerted within the drill string 12 prevents drilling fluid from entering the drill string 12 when the annulus is refilled with drilling fluid. The prevention of drilling fluid from flowing into the drill string reduces the quantity of drilling fluid required for refilling the annulus and prevents unnecessary movement of drilling fluid between the annulus and the drill string.

After the desired pressure level has been reached within the drill string 12, the annulus is refilled with drilling fluid by way of the conduit 30 connected to the nipple 26. Once the refilling operation is completed, the gas pressure exerted within the drill string 12 is released by exhausting it to the atmosphere, and the valve 44 connected to the adapter 42 is opened. At this point, the steps described above are repeated. That is, the blowout preventer apparatus 24 is again closed and pressurized gas is again introduced by way of the assembly 40 and conduits 38 and 18 into the annulus of the well bore to lower the level of drilling fluid therein and displace drilling fluid through the drill string 12, through the adapter 42, the valve 44 and hose 46 to the mud pits or circulating tanks. The gas pressure level in the annulus is predetermined and controlled so that upon release of the pressure the equalized level of drilling fluid in the drill string 12 is below the point of disconnection of drill pipe sections therefrom, but above the level at which blowouts occur. The pressure within the annulus is again released, the blowout preventer apparatus 24 opened and a second predetermined number of drill pipe sections removed from the drill string 12. As will now be apparent, the process of refilling the annulus with drilling fluid, displacing drilling fluid out of the well bore to insure overflow does not occur when drill pipe sections are removed from the drill string, and the removal of a predetermined number of drill pipe sections from the drill string is repeated until the desired number of drill pipe sections have been removed from the drill string, or until the entire drill string has been removed from the well bore. Thus, by the method of the present invention the drill string is removed from the well bore without incurring overflow of drilling fluid and with the location of the level of drilling fluid in the well bore known and maintained above the location where blowout conditions occur.

Figure 2:
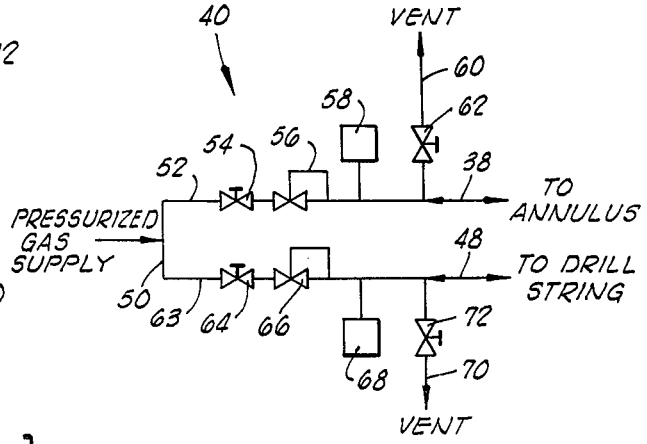
FIG. 2 is a schematic illustration of one form of control and recording apparatus which can be utilized for carrying out the method of the present invention.

Referring now to FIG. 2, the gas regulating and recording assembly 40 is illustrated schematically. The apparatus 40 is preferably mounted in a panel or in the driller's console at a location on the floor of the drilling rig 32 whereby it can be conveniently reached by the operator of the drilling rig 32. The apparatus 40 basically comprises a manifold 50 to which the conduit 41 is attached and leads a supply of pressurized gas. One end of a conduit 52 is attached to the manifold 50 with the other end being attached to the hose 38 leading to the annulus of the well bore 10. A shutoff valve 54 and a conventional downstream pressure regulator 56 are disposed in the conduit 52. A pressure recorder 58 which can be any of a variety of chart type pressure recorders is connected to the conduit 52 downstream of the pressure regulator 56. A conduit 60 is connected to the conduit 52 downstream of the recorder 58 which is open to the atmosphere or leads to a vent, and a shutoff valve 62 is disposed in the conduit 60. A second conduit 63 is attached to the manifold 50 and includes a shutoff valve and a downstream pressure regulator 66 disposed therein. A second pressure recorder 68 is connected to the conduit 63 downstream of the pressure regulator 66 and a conduit 70 is connected to the conduit 63 downstream of the pressure recorder 68 which is open to the atmosphere. A shutoff valve 72 is disposed in the conduit 70. The hose 48 leading to the adapter 42 is connected to the end of the conduit 63.

In operation of the assembly 40, when it is desired to introduce pressurized gas into the annulus of the well bore 10, the shutoff valve 54 is opened and the downstream pressure regulator 56 is set to control the pressure exerted within the annulus at a desired level. The pressure recorder 58 records the pressure level achieved within the annulus each time the annulus is pressured up thereby making a permanent record of the carrying out of the method of the present invention during the drilling operation. When it is desired to release the gas pressure from the annulus, the shutoff valve 54 is closed and the valve 62 is opened so that gas is back flowed through the conduit 38 and vented to the atmosphere.

When it is desired to introduce pressurized gas into the drill string, the shutoff valve 64 is opened and the pressure regulator 66 adjusted so that the desired pressure level is reached within the drill string. The pressure recorder 68 functions in the same manner as described above with respect to the pressure recorder 58, and when it is desired to release the gas pressure from the drill string, the valve 64 is closed and the valve 72 is opened to vent the gas to the atmosphere. The recorders 58 and 68 provide a continuous record of the pressure levels utilized during the withdrawal of the drill string from the well bore. This record provides a means of insuring that the drilling operators carry out the method and do not withdraw the drill string from the well bore without taking precautions to prevent unnecessary blowouts.

While any of a variety of pressurized gases can be utilized in accordance with the invention, compressed air is particularly suitable and is preferred in that a source of compressed air is generally available on drilling rigs. If necessary, an air compressor can be installed on the drilling rig at a relatively low cost.

In order to present a clear understanding of the present invention the following example is given.

EXAMPLE

A well bore is drilled to 10,000 feet with 4 ½ inch 20 pound conventional drill pipe. 9 ⅝ inch surface casing is set in the well bore at 3,000 feet, and the drilling fluid utilized has a density of 10 pounds per gallon. The annulus between the 4 ½ inch drill pipe and the surface casing has a volume of 0.0703 barrels per linear foot. The capacity of the drill pipe is 0.0129 barrels per linear foot and the drill pipe metal displaces 0.0077 barrels of drilling fluid per linear foot of drill pipe.

Because the formation penetrated by the well bore is of the sloughing type shale and contains fluids under pressure, it is determined that the hydrostatic pressure exerted on the formation by the column of drilling fluid in the well bore when filled with drilling fluid should not be decreased by more than 200 psi during the withdrawal of the drill string from the well bore.

The mud pumps are stopped and the blowout preventer is closed so that the annulus is sealed. Compressed air is injected into the annulus to a maximum pressure of 78 psig. which displaces drilling fluid downwardly in the annulus and upwardly through the drill string into the drilling fluid circulation tanks. When the pressure in the annulus reaches 78 psig., the level of drilling fluid in the annulus is at 150 feet below the ground surface, and 10.5 barrels of drilling fluid are displaced into the circulating tanks.

The air pressure in the annulus is released and the blowout preventer is opened which causes the drilling fluid within the annulus and the drill string to equalize. After equalization, the level of drilling fluid in the drill string is at 127 feet from the ground surface resulting in a decrease of hydrostatic pressure on the formation at the bottom of the well bore of 66 psi.

The withdrawal of the drill string and disconnection of drill pipe sections is commenced and continued until 900 feet of drill string has been removed from the well bore. The removal of 900 feet of 4 ½ drill pipe is equivalent to removing 6.93 barrels of drilling fluid from the well bore which lowers the level of drilling fluid in the annulus to 232 feet from the ground surface. This results in a total decrease of hydrostatic pressure exerted by the column of drilling fluid on the bottom of the well bore of 128 psi. At this point, the annulus is refilled with drilling fluid and the procedure described above repeated, including the withdrawal of a second 900 feet of drill pipe. The procedure is continued until the entire drill string is removed from the well bore.

Thus, the present invention is well adapted to carry out the objects and attain the ends and advantages mentioned as well as those inherent therein. While presently preferred embodiments of the invention have been described for purposes of this disclosure, numerous changes in the arrangement of parts and order of steps will suggest themselves to those skilled in the art, which changes are encompassed in the spirit of this invention.

What is claimed is:

1. A method of preventing drilling fluid overflow and the occurrence of uncontrolled formation fluid blowouts when removing drill pipe sections from a drill string disposed in a well bore penetrating a subterranean formation and filled with drilling fluid comprising the steps of:

a. introducing a gas into the annulus between the walls of said well bore and said drill string until a predetermined gas pressure is reached therewithin thereby displacing drilling fluid downwardly within said annulus and upwardly through said drill string to lower the level of drilling fluid in said annulus a distance such that upon releasing the gas pressure from said annulus the resulting level of drilling fluid in said drill string is below the level at which said drill pipe sections are disconnected therefrom, but the level of drilling fluid in said well bore is above the level at which the hydrostatic head exerted on said formation by said drilling fluid equals the pressure of fluids contained within said formation;

b. releasing said gas pressure from said annulus;

c. removing a predetermined number of drill pipe sections from said drill string thereby raising said drill string within said well bore and lowering the level of drilling fluid therein, the number of such sections removed being limited so that the level of drilling fluid in said well bore is maintained above the level at which the hydrostatic head exerted on said formation by said drilling fluid equals the pressure of fluids contained within said formation;

d. refilling said annulus with drilling fluid; and e. repeating steps (a) through (d) until the desired number of drill pipe sections are removed from said drill string.

2. The method of claim 1 which is further characterized to include the step of recording the gas pressure reached within said annulus during step (a).

3. The method of claim 1 wherein said gas is compressed air.

4. The method of claim 2 which is further characterized to include the steps of:

introducing a gas into said drill string prior to refilling said annulus in accordance with step (d) until a predetermined pressure is reached therewithin whereby drilling fluid is prevented from flowing into the drill string through the bottom thereof while said annulus is refilled; and releasing said gas pressure from within said drill string after refilling said annulus.

5. The method of claim 4 which is further characterized to include the step of recording the gas pressure within said drill string.

* * * * *